US011757228B2

(12) United States Patent
Lai et al.

(10) Patent No.: US 11,757,228 B2
(45) Date of Patent: Sep. 12, 2023

(54) CONNECTOR USED IN UNDERWATER ENVIRONMENTS

(71) Applicant: AVERTRONICS INC., Taichung (TW)

(72) Inventors: Austin Lai, Taichung (TW); Chi-I Lai, Taichung (TW); Hsun-Ya Shih, Taichung (TW)

( * ) Notice: Subject to any disclaimer, the term of this patent is extended or adjusted under 35 U.S.C. 154(b) by 139 days.

(21) Appl. No.: 17/411,861

(22) Filed: Aug. 25, 2021

(65) Prior Publication Data

US 2023/0067836 A1 Mar. 2, 2023

(51) Int. Cl.

| | |
|---|---|
| ***H01R 13/50*** | (2006.01) |
| ***H01R 13/52*** | (2006.01) |
| ***H01R 13/523*** | (2006.01) |
| ***H01R 13/66*** | (2006.01) |

(52) U.S. Cl.
CPC ..... *H01R 13/5221* (2013.01); *H01R 13/523* (2013.01); *H01R 13/6683* (2013.01)

(58) Field of Classification Search
CPC ..... H01R 13/5221; H01R 13/523; H01R 13/6683

See application file for complete search history.

(56) References Cited

U.S. PATENT DOCUMENTS

| | | | | |
|---|---|---|---|---|
| 10,490,931 | B2* | 11/2019 | Furuya et al. | H01R 13/5208 |
| 11,152,747 | B2* | 10/2021 | Shioda et al. | H01R 12/91 |
| 11,189,943 | B2* | 11/2021 | Zerebilov et al. | G02B 6/428 |
| 2008/0139028 | A1* | 6/2008 | Burris et al. | H01R 13/5219 439/585 |
| 2010/0197420 | A1* | 8/2010 | Lim | A63B 57/40 473/409 |
| 2022/0140547 | A1* | 5/2022 | Hügel et al. | H01R 13/6272 439/578 |

* cited by examiner

*Primary Examiner* — Phuong Chi Thi Nguyen
(74) *Attorney, Agent, or Firm* — Che-Yang Chen; Law Office of Michael Chen

(57) ABSTRACT

A connector used in underwater environments includes a male connector with a sensing terminal and two power terminals, a female connector with a sensing terminal block and two power terminal blocks, and an elastic gasket set between the male connector and the female connector. When the male connector and the female connector are plugged into each other, and the male and female connectors squeeze the elastic gasket to form a large amount of deformation, the sensing terminal and the sensing terminal block are in contact with each other. When the male and female connectors squeeze the elastic gasket to form a small deformation state, the sensing terminal and the sensing terminal block are separated from each other, and the power terminals and the power terminal blocks are in contact with each other, thereby forming a waterproof protection mechanism.

9 Claims, 11 Drawing Sheets

B-B

CONNECTOR USED IN UNDERWATER ENVIRONMENTS

BACKGROUND OF THE INVENTION

1. Field of the Invention

The present invention relates to a connector structure, in particular to a connector used in underwater environments that senses the deformation of an elastic gasket to achieve a waterproof protection mechanism.

2. Description of the Related Art

Connectors are mainly used to connect power, signal sources and various electronic devices to provide power or transmit signals. They are one of the indispensable important electrical components. Since the wire itself has the characteristics of flexing arbitrarily and is used in various complex applications, how to reduce the size and not easy to detach is the key point of the common connector that needs to be improved. Specifically, when the use environment is a ship or underwater environment, the electrical equipment is in a state of continuous shaking during use, which may easily cause the connector to detach. Moreover, the connector must continue to withstand water pressure in the underwater environment, and the waterproof requirement of the connector is higher. As long as the connector is slightly loose, the connector is easy to enter water, and serious cases may even cause damage to electrical equipment or personal injury. Therefore, the conventional connector design for special use environment or underwater environment adopts a fastening structure that is not easy to fall off, and the layered protection of multiple gaskets is used to prevent the connector from entering water. Because assembling multiple gaskets will increase the size of the connector, it is not suitable for special environments and underwater environments. Furthermore, in fact, it has not been considered that when the connector is used in a ship or underwater environment, the connector is not easy to maintain or detect. After the connector is slightly loose, it will inevitably continue to expand the looseness to water damage, causing the connector to be found after water damage, so there is a serious potential use risk. Comprehensive above-mentioned deficiency is the technical problem that the present invention intends to improve.

In view of this, the inventor has been engaged in the manufacturing, development and design experience of related products for many years, and after detailed design and careful evaluation for the above-mentioned goals, he finally obtained a practical invention.

SUMMARY OF THE INVENTION

The technical problem to be solved by the present invention is to provide a connector used in underwater environments in view of the above-mentioned deficiencies in the prior art, which comprises a male connector, a female connector and an elastic gasket. The male connector comprises a sensing terminal and two power terminals. The female connector is connectable with the male connector by plugging the male connector into the female connector. The female connector comprises a sensing terminal block and two power terminal blocks. The elastic gasket is set between the male connector and the female connector. when the male connector and the female connector are plugged into each other, and the male connector and the female connector squeeze the elastic gasket to form a large amount of deformation, the sensing terminal and the sensing terminal block are in contact with each other. When the male connector and the female connector squeeze the elastic gasket to form a small deformation state, the sensing terminal and the sensing terminal block are separated from each other, and the power terminals and the power terminal blocks are in contact with each other, thereby forming a waterproof protection mechanism.

Preferably, the elastic gasket comprises a first surface conflicting with the male connector to form, and a second surface conflicting with the female connector. The distance between the first surface and the second surface forms a first distance. The elastic gasket is compressed by the first surface and the second surface to form a second distance and a third distance. The distance of the first distance is greater than the distance of the second distance, and the distance of the second distance is greater than the distance of the third distance. When the compression deformation of the elastic gasket is between the second distance and the third distance, the sensing terminal and the sensing terminal block are connected to each other. When the compression deformation of the elastic gasket is greater than the first distance, and the compression deformation of the elastic gasket is less than or equal to the second distance, the sensing terminal and the sensing terminal block are disconnected from each other.

Preferably, the male connector fixes the bottom of the sensing terminal and the power terminal with a base, and allows the sensing terminal and the power terminals to extend in the same direction with a predetermined length. The base has an outer edge thereof formed with a ring to surround the sensing terminal and the power terminals. The ring forms a male end extrusion surface at an end thereof far away from the base. The female connector is provided with an annular portion around respective outer edges of the sensing terminal block and the power terminal blocks. The annular portion has a female end extrusion surface convexly formed at the bottom thereof. The elastic gasket is sleeved on the annular portion, and the second surface conflicts with the female end extrusion surface. The female connector is inserted into the ring of the male connector with the annular portion, so that the male end extrusion surface interferes with the second surface.

Preferably, the ring has an inner wall surface thereof formed with an enlarged opening with a gradually larger inner diameter from the base to the male end extrusion surface, and the annular portion is formed with a shrinking cone with a smaller outer diameter outward from the female end extrusion surface When the ring is nested in the annular portion, the ring and the annular portion are separated from each other, and the male end extrusion surface interferes with the relatively outer edge of the elastic gasket.

Preferably, the male connector is provided with a plurality of signal terminals, and the female connector is provided with a plurality of signal terminal blocks. The length of the signal terminals protruding from the base is greater than the length of the sensing terminal. After the power terminals and he power terminal blocks are respectively in contact with each other, the signal terminals and the signal terminal blocks can be in contact. Before the signal terminals and the signal terminal blocks are respectively separated from each other, the sensing terminals and the sensing terminal blocks have been separated.

Preferably, the male connector is equipped with a sleeve. The sleeve is formed with an internal threaded portion at the inner edge of one end thereof, and the sleeve being shrunk at an opposite end thereof to form a blocking ring. The ring forms a blocking surface on an opposite side of the male end extrusion surface, so that the blocking surface blocks the blocking ring in one direction. The female connector comprises an external threaded portion formed on an outer surface thereof. The female end extrusion surface is located between the external threaded portion and he annular portion. The internal threaded portion of the sleeve is locked on the external threaded portion to form a clamping extrusion of the male end extrusion surface and the female end extrusion surface to the elastic gasket.

Preferably, the male connector comprises a round tube extending in the opposite direction where the ring is provided. The round tube comprises a retaining ring at one end thereof away from the blocking surface. The blocking ring of the sleeve is limited to be located between the retaining ring and the blocking surface.

Preferably, the male connector is injected with rubber at the round tube and combined with a jacket. The retaining ring is protruding from the jacket, and an annular slope is formed at the retaining ring facing away from the blocking surface. The sleeve is cut to provide a plurality of slots at the blocking ring, and the slots allow the blocking ring to flexibly cross the annular slope and be assembled at the male connector.

Preferably, the male connector comprises a partition protruding from the center of the base. The partition is spaced between the two power terminals. The partition forms an arc edge. The female connector is provided with a shell protruding from the inner edge of the annular portion and used to fix the power terminal blocks. The shell is recessed with a groove between the two power terminal blocks. The groove forms a circular arc recess. When the arc edge of the partition is aligned with the circular arc recess of the shell, the male connector and the female connector can be inserted into each other.

Preferably, the male connector and the female connector only sandwich the elastic gasket which is used as a waterproof function.

The first main purpose of the present invention is that when the male connector and the female connector squeeze the elastic gasket to form a large amount of deformation, the sensing terminal and the sensing terminal block are in contact with each other, and when the elastic gasket is squeezed to form a small deformation state, the sensing terminal and the sensing terminal block are not in contact with each other. In this way, a waterproof protection mechanism is formed through the unguided communication signal, which is used in the underwater environment that is inconvenient for inspection and maintenance and high water pressure and easy to leak, so as to have the effect of real-time maintenance and protection of electrical products.

The second main purpose of the present invention is that the internal threaded portion of the sleeve is locked on the external threaded portion to form a sandwich extrusion of the male end extrusion surface and the female end extrusion surface on the elastic gasket, thereby forming a sufficient waterproof effect. Coupled with the waterproof warning function of the sensing terminal, only the elastic gasket that is used as a waterproof function is sandwiched between the male connector and the female connector. This can effectively reduce the overall size of the connector, and the small-sized connector can be more suitable for ships, underwater environments or deep water environments, thereby overcoming the problem of high pressure and easy water leakage in the water.

The third main purpose of the present invention is that when the male connector and the female connector are connected, the power terminals and the power terminal blocks are connected first, and then the signal terminals and the signal terminal blocks are further connected. At this time, the power terminals and the signal terminals are kept in the waiting state of not conducting power and transmitting signals. Finally, when the sensing terminal is inserted into the sensing terminal block, it will be activated through the sensing terminal's conductive signal to turn on the power and transmit the signal. This prevents the power terminals and the power terminal blocks from generating an arc at the moment of contact, so as to improve the safety of the use of the connector.

Other purposes, advantages and novel features of the present invention will be more apparent from the following detailed description and related drawings.

DETAILED DESCRIPTION OF THE INVENTION

Figure 1:
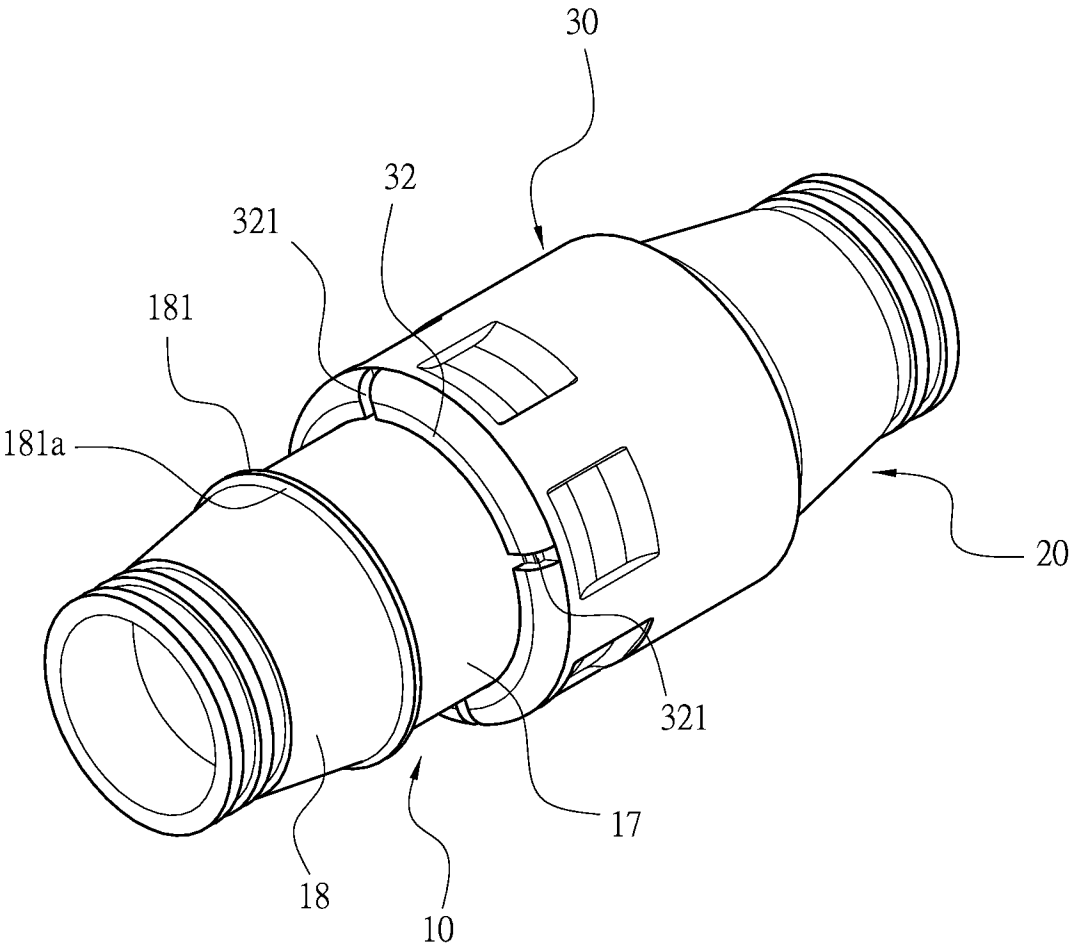
FIG. 1 is an oblique top elevational view of a connector used in underwater environments in accordance with the present invention.
Figure 2:
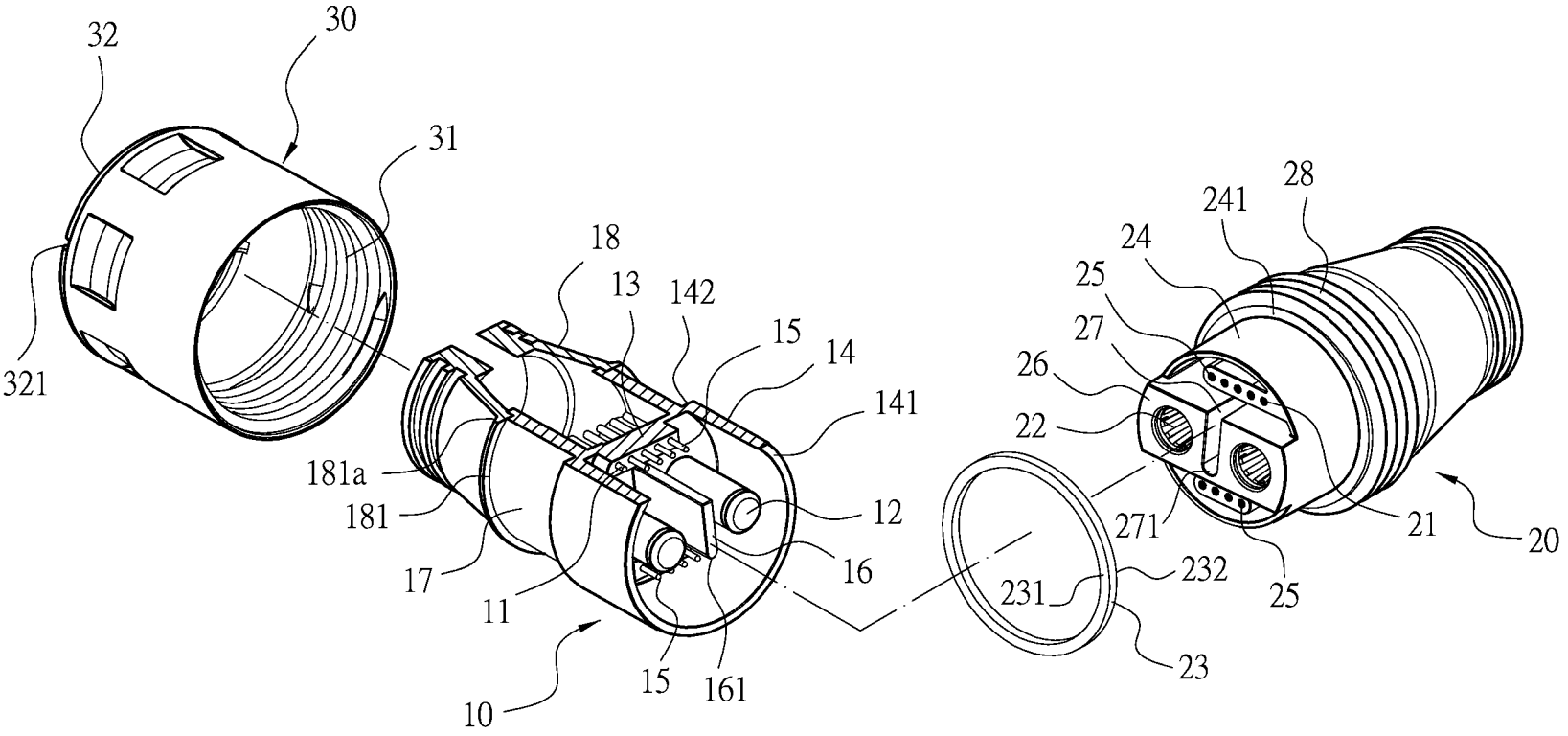
FIG. 2 is an exploded view of the connector used in underwater environments in accordance with the present invention.
Figure 3:
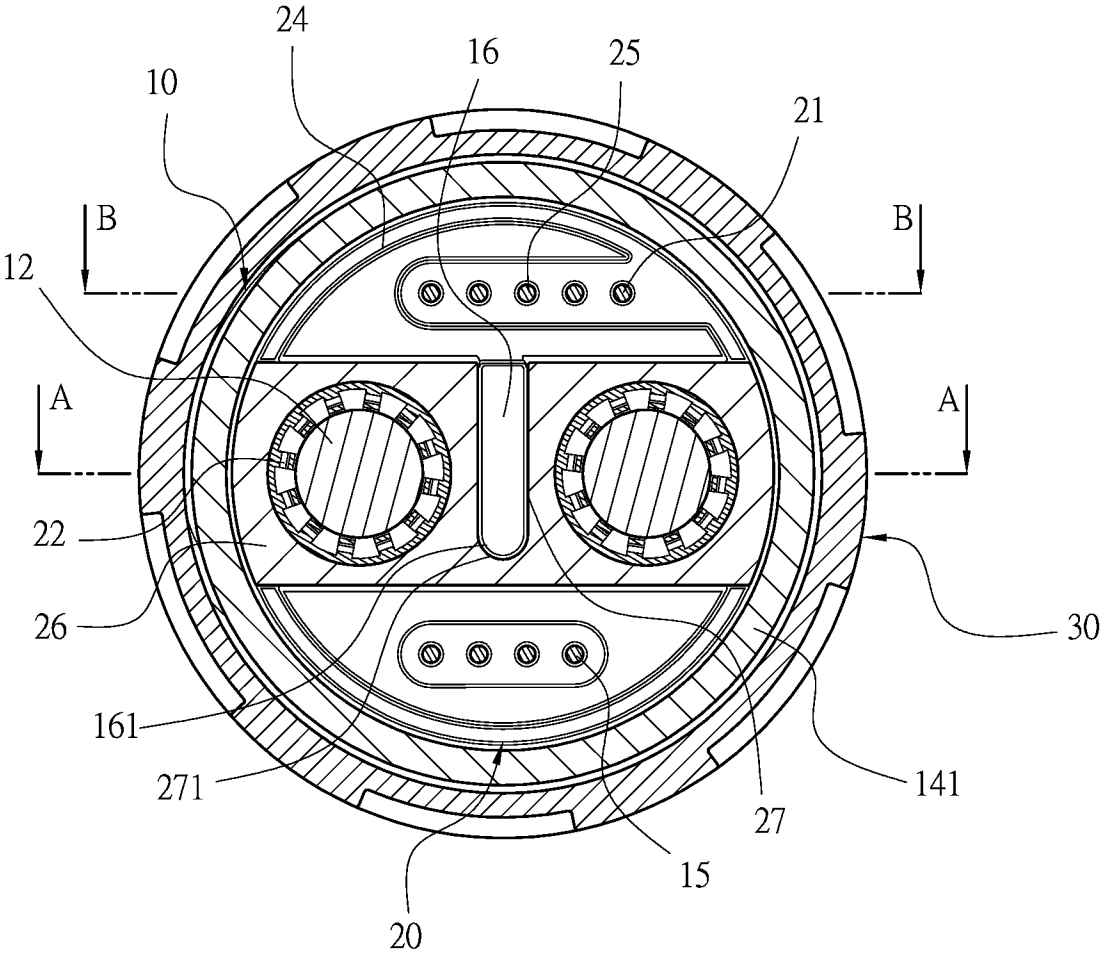
FIG. 3 is a cross sectional view of the connector used in underwater environments in accordance with the present invention.
Figure 4:
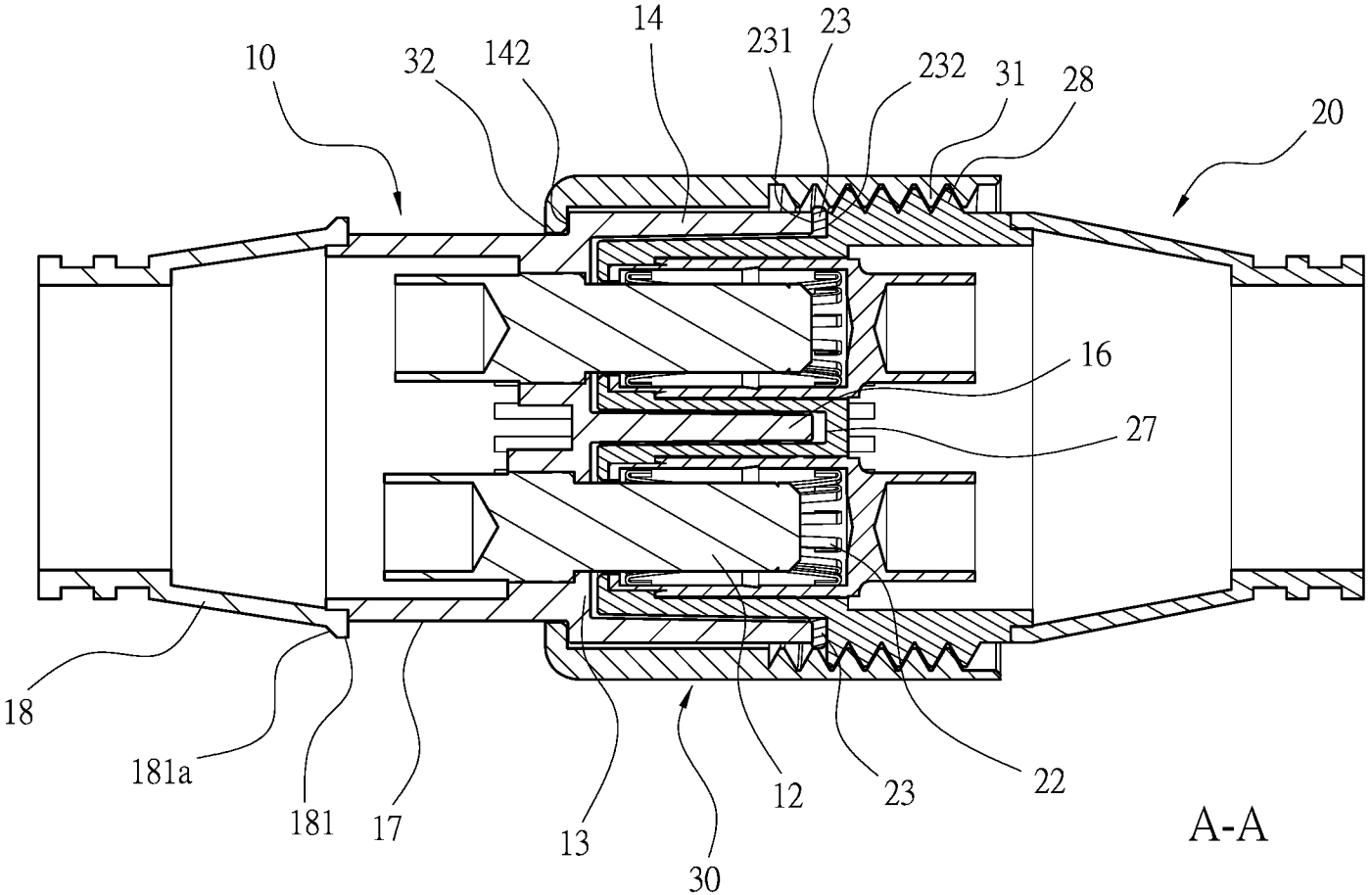
FIG. 4 is a sectional view taken along line A-A of FIG. 3.
Figure 5:
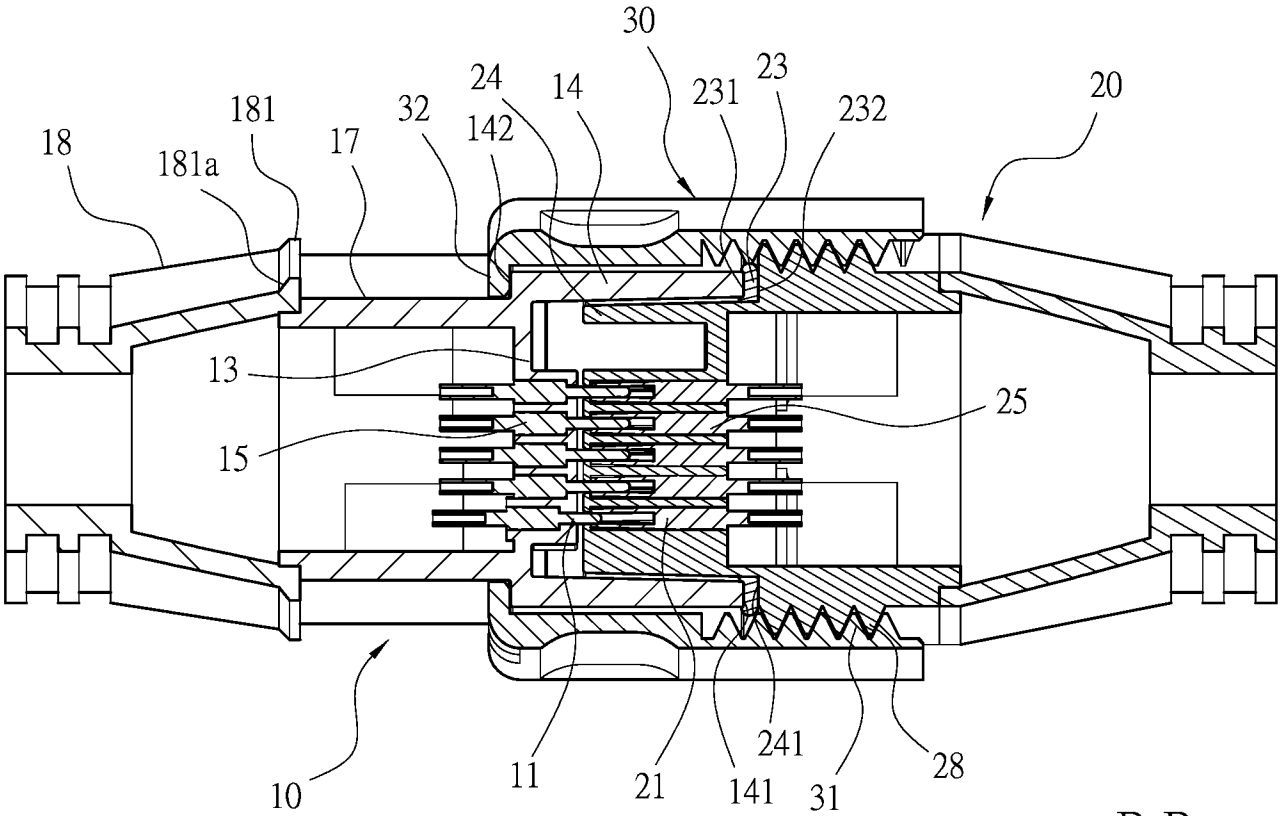
FIG. 5 is a sectional view taken along line B-B of FIG. 3.
Figure 6:
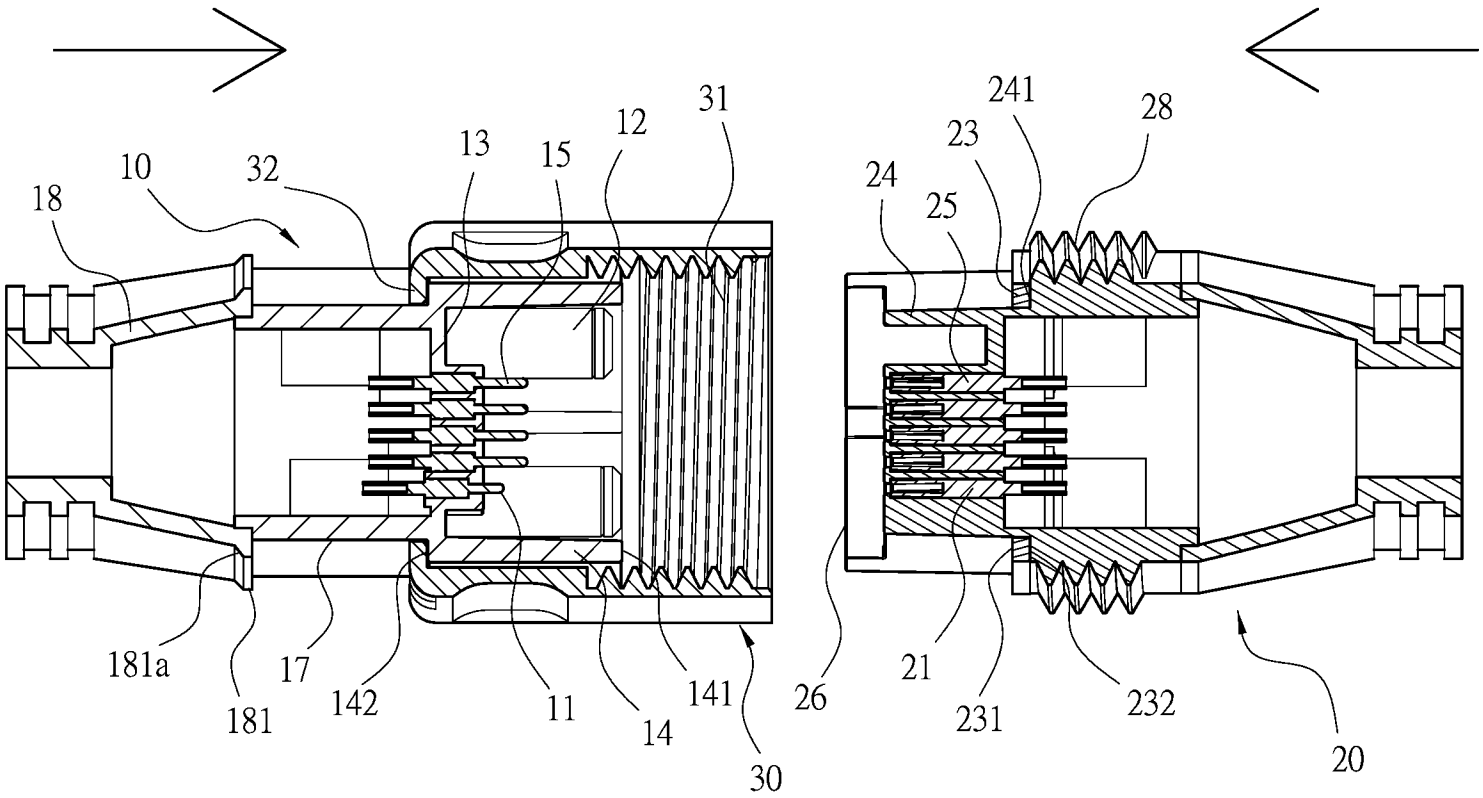
FIG. 6 is a cross-sectional view of the male connector and the female connector of the present invention that are engaged with each other.
Figure 7:
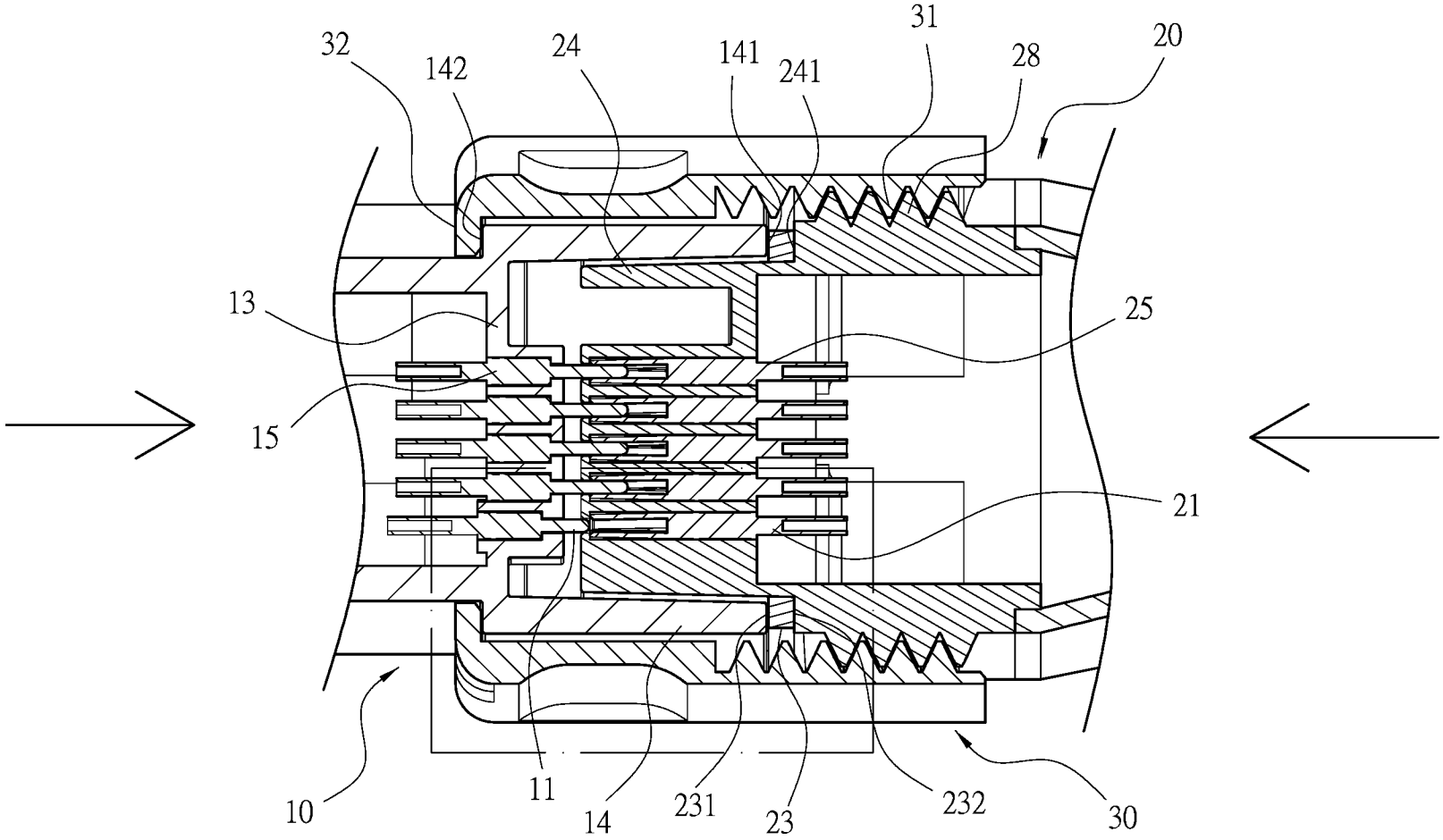
FIG. 7 is a schematic diagram of the present invention in the undeformed state of the elastic gasket.
Figure 8:
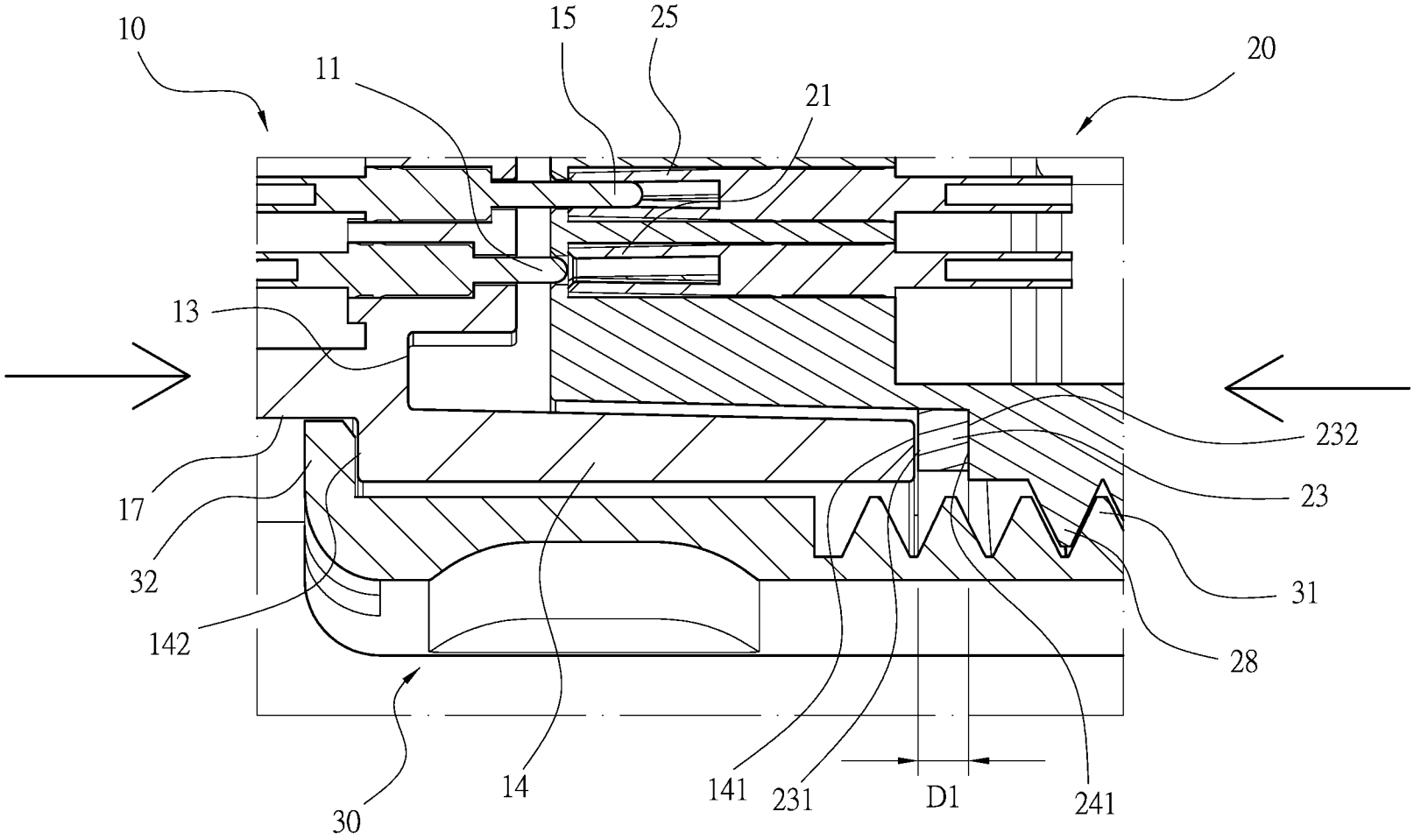
FIG. 8 is a partial enlarged schematic diagram of the present invention in FIG. 7.
Figure 9:
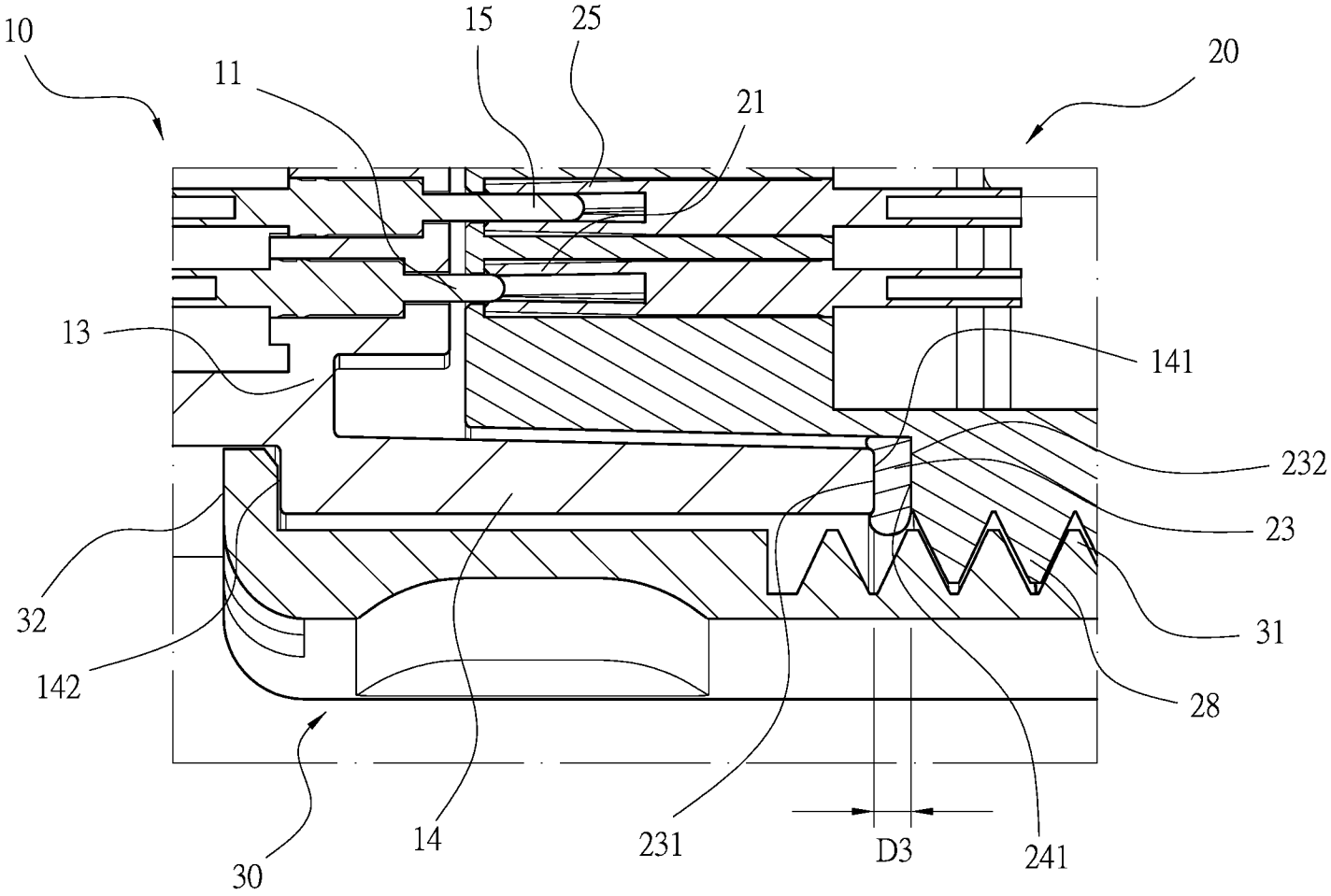
FIG. 9 is a schematic diagram of the present invention in a large deformation state of the elastic gasket.
Figure 10:
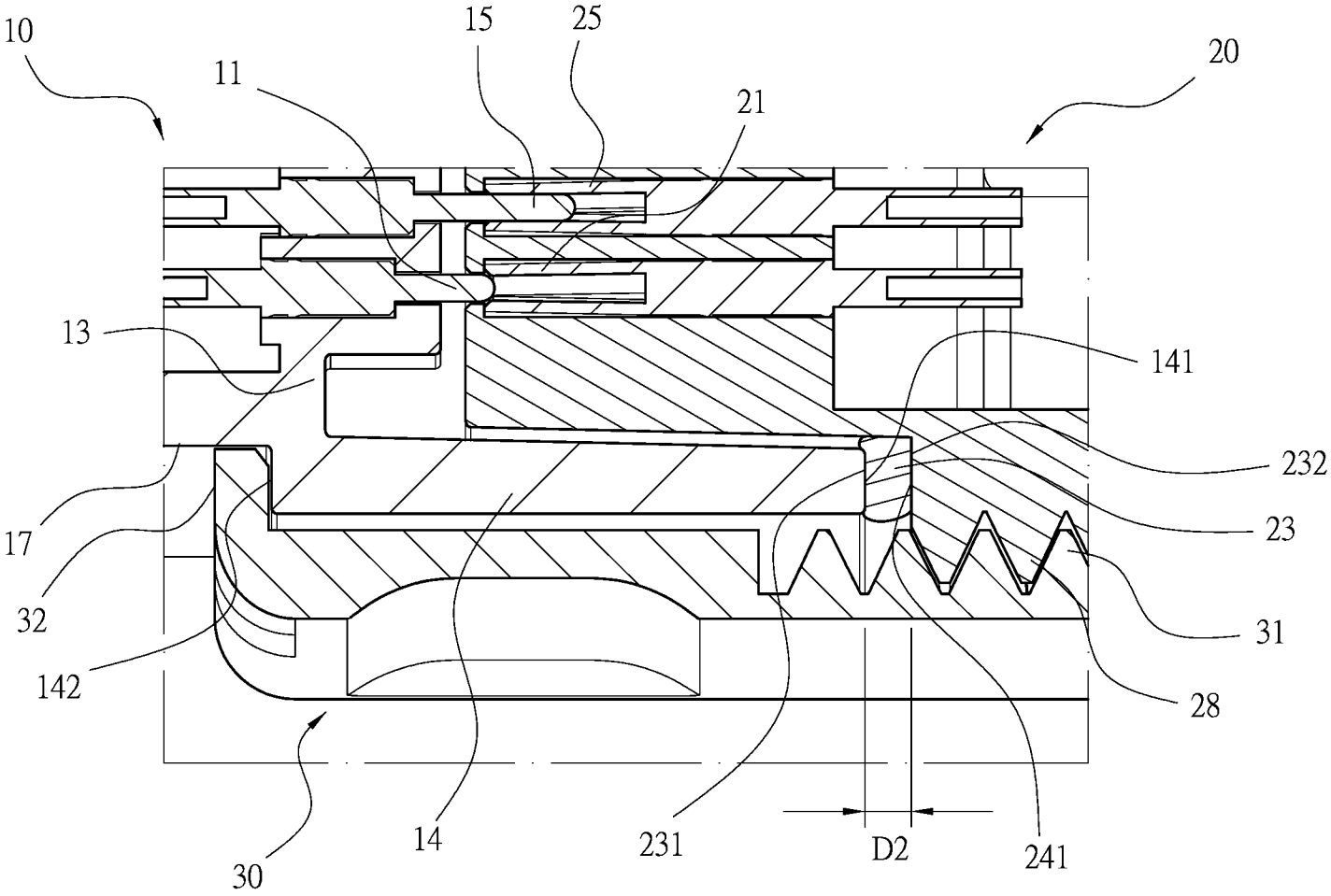
FIG. 10 is a schematic diagram of the present invention in a small deformation state of the elastic gasket.

In order to enable your review committee to have a further understanding of the purpose, features and effects of the present invention, please cooperate with the following (a brief description of the drawings) as detailed below:

Referring to FIGS. 1-10, a connector used in underwater environments provided by the present invention comprises a male connector 10, a female connector 20, and a sleeve 30. The male connector 10 is provided with a sensing terminal 11 and two power terminals 12. The female connector 20 is provided with a sensing terminal block 21 and two power terminal blocks 22. The male connector 10 and the female connector 20 are inserted into each other to sandwich an elastic gasket 23, that is, the male connector 10 and the female connector 20 are sandwiched only with the elastic gasket 23 that is only used as a waterproof function, thereby effectively reducing the overall volume of the connector. The small size of the connector is more suitable for ships, underwater environments or deep water environments to overcome the problem of high pressure and easy water leakage in the water. With the above structure, when the male connector 10 and the female connector 20 squeeze the elastic gasket 23 to form a large amount of deformation, the sensing terminal 11 and the sensing terminal block 21 are in contact with each other, and a continuous conductive signal is generated. In addition, when the male connector 10 and the female connector 20 squeeze the elastic gasket 23 to form a small deformation state, the sensing terminal 11 and the sensing terminal block 21 are not in contact with each other, and the power terminals 12 and the power terminal blocks 22 are respectively in contact with each other. By this way, a waterproof protection mechanism is formed through the unguided communication signal. The large deformation state and the small deformation state are relative sizes, and the amount of deformation is not limited. The waterproof protection mechanism can use the separation of the sensing terminal 11 and the sensing terminal block 21 to generate a detection signal, thereby warning the user to troubleshooting. Or when the sensing terminal 11 is separated from the sensing terminal block 21, the conductive state of the power terminals 12 and the power terminal blocks 22 is automatically cut off, which is used in the underwater environment where inspection and maintenance are inconvenient and high water pressure is easy to leak, in order to have the effect of real-time maintenance and protection of electrical products.

To further illustrate, the elastic gasket 23 has a first surface 231 facing the male connector 10, and a second surface 232 facing the female connector 20. The distance between the first surface 231 and the second surface 232 forms a first distance D1, and the elastic gasket 23 is compressed by the first surface 231 and the second surface 232 to form a second distance D2 and a third distance D3. The distance of the first distance D1 is greater than the distance of the second distance D2, and the distance of the second distance D2 is greater than the distance of the third distance D3. When the compression deformation of the elastic gasket 23 is between the second distance D2 and the third distance D3, the sensing terminal 11 and the sensing terminal block 21 are connected to each other. When the compression deformation of the elastic gasket 23 is greater than the first distance D1, and the compression deformation of the elastic gasket 23 is less than or equal to the second distance D2, the sensing terminal 11 and the sensing terminal block 21 are not connected to each other. Therefore, when the male connector 10 and the female connector 20 are located at the ideal mating position with each other, the elastic gasket 23 is squeezed and deformed between the second distance D2 and the third distance D3, and passes through the deformation of the elastic gasket 23, an effective waterproof effect can be formed in the underwater environment. When the pressing force of the male connector 10 and the female connector 20 on the elastic gasket 23 becomes smaller, that is, the deformation of the elastic gasket 23 is between the first distance D1 and the second distance D2, and there is still waterproof effect, but it also means that the connector is facing a state of almost leaking water. At this time, through the separation of the sensing terminal 11 and the sensing terminal block 21, the waterproof protection mechanism can be activated early to prevent damage to the equipment caused by water leakage and short circuit, so as to improve its safety.

The specific structural feature of the present invention is that the male connector 10 uses a base 13 to fix the bottom of the sensing terminal 11 and the power terminals 12, and allows the sensing terminal 11 and the power terminals 12 to extend in the same direction with an appropriate length. The outer edge of the base 13 is formed with a ring 14 that can surround the sensing terminal 11 and the power terminals 12, and the ring 14 is formed with a male end extrusion surface 141 at the end far away from the base 13. The female connector 20 is provided with an annular portion 24 around the outer edges of the sensing terminal block 21 and the power terminal block 22, and the bottom of the annular portion 24 protrudes to form a female end extrusion surface 241. The elastic gasket 23 is sleeved on the annular portion 24, and the second surface 232 conflicts with the female end extrusion surface 241. The female connector 20 is inserted into the ring 14 of the male connector 10 with the annular portion 24, so that the male end extrusion surface 141 interferes with the second surface 232. The male connector 10 is also equipped with the sleeve 30. The sleeve 30 has an internal threaded portion 31 formed at the inner edge of one end, and the sleeve 30 is retracted to form a blocking ring 32 at the other end. The ring 14 has a blocking surface 142 formed on the opposite surface of the male end extrusion surface 141, so that the blocking surface 142 blocks the blocking ring 32 in one direction. An external threaded portion 28 is formed on the outer surface of the female connector 20, and the female end extrusion surface 241 is located between the external threaded portion 28 and the annular portion 24. The internal threaded portion 31 of the sleeve 30 is locked on the external threaded portion 28 to form the clamping and extrusion of the male end extrusion surface 141 and the female end extrusion surface 241 to the elastic gasket 23, that is, the first surface 231 and the second surface 232 of the elastic gasket 23 form the technical means of positive extrusion.

Figure 11:
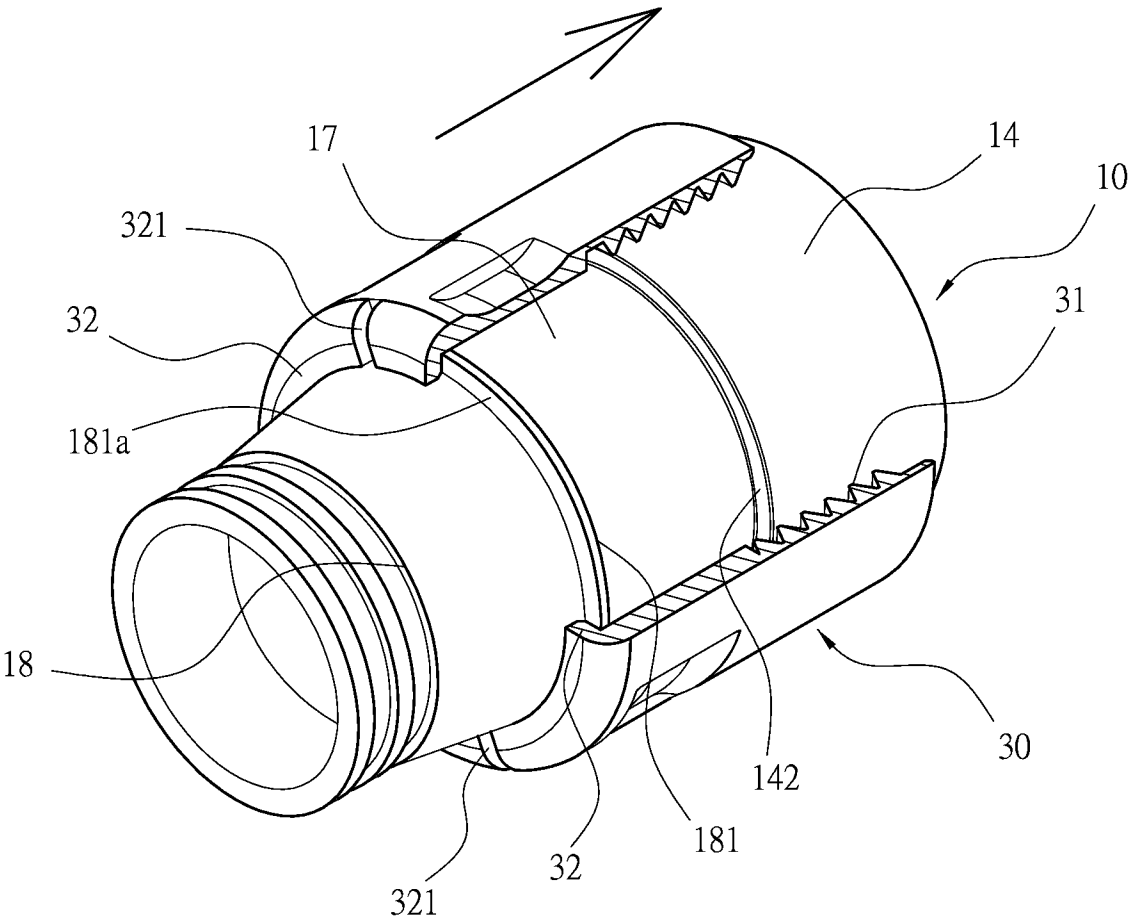
FIG. 11 is a schematic diagram of the present invention in the step of assembling the sleeve

As shown in FIG. 11, the male connector 10 has a round tube 17 extending in the other direction where the ring 14 is provided, and the round tube 17 forms a retaining ring 181 at one end away from the blocking surface 142. The blocking ring 32 of the sleeve 30 is limited to be located between the retaining ring 181 and the blocking surface 142. The male connector 10 is injected with rubber at the round tube 17 and combined with a jacket 18, and the retaining ring 181 is protruded from the jacket 18. An annular slope 181a facing away from the blocking surface 142 is formed at the retaining ring 181. The sleeve 30 is cut with a plurality of slots 321 at the blocking ring 32. With the above structure, the male connector 10 can first perform the wiring of the sensing terminal 11 and the power terminals 12, and after the rubber of the jacket 18 is injection molded, then perform the combination step of the sleeve 30 and the male connector 10. That is, the slots 321 are used to allow the blocking ring 32 to flexibly cross the annular slope 181a, so that the blocking ring 32 is limited to be located between the retaining ring 181 and the blocking surface 142, and the sleeve 30 is assembled at the male connector 10. According to this improvement, when the sleeve 30 is installed and then the wiring and injection processing steps are carried out, the whole group of defective products are discarded together, so as to achieve the effect of improving the production process.

The inner wall surface of the ring 14 is formed with an enlarged opening with a gradually larger inner diameter from the base 13 to the male end extrusion surface 141, and the annular portion 24 is outwardly formed with a reduced cone with a smaller outer diameter from the female end extrusion surface 241. When the ring 14 is nested into the annular portion 24, the ring 14 and the annular portion 24 do not touch each other, that is, when the annular portion 24 of the female connector 20 is just inserted into the ring 14 of the male connector 10, the enlarged opening of the ring 14 can facilitate the aligned insertion of the reduced cone of the annular portion 24, thereby achieving the purpose of easy assembly. Furthermore, the male connector 10 is protrudingly provided with a partition 16 in the center of the base 13, and the partition 16 is spaced between the two power terminals 12. When the male connector 10 and the female connector 20 are just about to be mated, the partition 16 is used to block between the power terminals 12 and the power terminal blocks 22, which can effectively increase the creepage distance, thereby preventing the power terminals 12 and the power terminal blocks 22 from arcing at the moment of contact. The partition 16 forms an arc edge 161. The female connector 20 is provided with a shell 26 protruding from the inner edge of the annular portion 24. The shell 26 is used to fix the power terminal blocks 22. The shell 26 is recessed with a groove 27 between the two power terminal blocks 22, and the groove 27 is formed with a circular arc recess 271. When the arc edge 161 of the partition 16 is aligned with the circular arc recess 271 of the shell 26, the male connector 10 and the female connector 20 can be inserted into each other, thereby achieving the function of mating and foolproof. Furthermore, when the male connector 10 and the female connector 20 are inserted into each other to extrude the elastic gasket 23, the male end extrusion surface 141 is in contact with the relative outer edge of the elastic gasket 23, that is, the relative inner edge of the elastic gasket 23 is located at the gap between the ring 14 and the annular portion 24. This allows the elastic gasket 23 to partially squeeze into the gap during elastic deformation, thereby improving its air-tight effect, and at the same time stably controlling the elastic deformation direction of the elastic gasket 23. It is also worth noting that the locking action of the internal threaded portion 31 of the sleeve 30 and the external threaded portion 28 of the female connector 20 does not generate a torsion force on the elastic gasket 233. Accordingly, the deformation state of the elastic gasket 23 can be controlled more accurately.

The male connector 10 is provided with a plurality of signal terminals 15, and the female connector 20 is provided with a plurality of signal terminal blocks 25. The length of the signal terminals 15 protruding from the base 13 is greater than the length of the sensing terminal 11. After the power terminals 12 and the power terminal blocks 22 are respectively in contact with each other, the signal terminals 15 and the signal terminal blocks 25 will be in contact. Before the signal terminals 15 and the signal terminal blocks 25 are respectively separated from each other, the sensing terminal 11 and the sensing terminal block 21 have been separated. In summary, when the male connector 10 and the female connector 20 are mated, the partition 16 will be inserted into the groove 27 first, and the arc edge 161 and the circular arc recess 271 will form a foolproof function. After joining the power terminals 12 and the power terminal blocks 22, further join the signal terminals 15 and the signal terminal blocks 25. At this time, both the power terminals 12 and the signal terminals 15 remain in the waiting state of not conducting power and transmitting signals. Finally, when the sensing terminal 11 is inserted into the sensing terminal block 21, it will be activated through the sensing terminal 11's conductive signal to turn on the power and transmit the signal. This prevents the power terminals 12 and the power terminal blocks 22 from generating an arc at the moment of contact, so as to improve the safety of their use.

In summary, the present invention has indeed achieved a breakthrough structural design, and has an improved content of the invention, and at the same time, it can achieve industrial utilization and progress. This invention has not been seen in any publications, and it is also novel. When it complies with the relevant provisions of the Patent Law, I file an application for a patent for invention in accordance with the law. I implore the review committee to grant legal patent rights. I really pray.

The above is only one of the preferred embodiments of the present invention, and it cannot be used to limit the scope of implementation of the present invention; that is, all equal changes and modifications made according to the scope of the patent application of the present invention should still fall within the scope of the patent of the present invention.

What is claimed is:

1. A connector used in underwater environments, comprising:

a male connector comprising a sensing terminal and two power terminals;

a female connector connectable with said male connector by plugging said male connector into said female connector, said female connector comprising a sensing terminal block and two power terminal blocks; and an elastic gasket set between said male connector and said female connector;

wherein when said male connector and said female connector are plugged into each other, and said male connector and said female connector squeeze said elastic gasket to form a large amount of deformation, said sensing terminal and said sensing terminal block are in contact with each other; when said male connector and said female connector squeeze said elastic gasket to form a small deformation state, said sensing terminal and said sensing terminal block are separated from each other, and said power terminals and said power terminal blocks are in contact with each other, thereby forming a waterproof protection mechanism;

wherein said elastic gasket comprises a first surface conflicting with said male connector to form and a second surface conflicting with said female connector; the distance between said first surface and said seond surface forms a first distance; said elastic gasket is compressed by said first surface and said second surface to form a second distance and a third distance; the distance of said first distance is greater than the distance of said second distance, and the distance of said second distance is greater than the distance of said third distance; when the compression deformation of said elastic gasket is between said second distance and said third distance, said sensing terminal and said sensing terminal block are connected to each other; when the compression deformation of said elastic gasket is greater than said first distance, and the compression deformation of said elastic gasket is less than or equal to said second distance, said sensing terminal and said sensing terminal block are disconnected from each other.

2. The connector used in underwater environments as claimed in claim 1, wherein said male connector and said female connector only sandwich said elastic gasket which is used as a waterproof function.

3. The connector used in underwater environments as claimed in claim 1, wherein said male connector fixes a bottom of said sensing terminal and said power terminal with a base, and allows said sensing terminal and said power terminals to extend in the same direction with a predetermined length, said base having an outer edge thereof formed with a ring to surround said sensing terminal and said power terminals, said ring forming a male end extrusion surface at an end thereof far away from said base; said female connector is provided with an annular portion around respective outer edges of said sensing terminal block and said power terminal blocks, said annular portion having a female end extrusion surface convexly formed at a bottom thereof; said elastic gasket is sleeved on said annular portion, and said second surface conflicts with said female end extrusion surface; said female connector is inserted into said ring of said male connector with said annular portion, so that said male end extrusion surface interferes with said second surface.

4. The connector used in underwater environments as claimed in claim 3, wherein said ring has an inner wall surface thereof formed with an enlarged opening with a gradually larger inner diameter from said base to said male end extrusion surface, and said annular portion is formed with a shrinking cone with a smaller outer diameter outward from said female end extrusion surface; when said ring is nested in said annular portion, said ring and said annular portion are separated from each other, and said male end extrusion surface interferes with a relatively outer edge of said elastic gasket.

5. The connector used in underwater environments as claimed in claim 3, wherein said male connector is provided with a plurality of signal terminals, and said female connector is provided with a plurality of signal terminal blocks; the length of said signal terminals protruding from said base is greater than the length of said sensing terminal; after said power terminals and said power terminal blocks are respectively in contact with each other, said signal terminals and said signal terminal blocks are to be in contact, and before said signal terminals and said signal terminal blocks are respectively separated from each other, said sensing terminals and said sensing terminal blocks have been separated.

6. The connector used in underwater environments as claimed in claim 3, wherein said male connector comprises a partition protruding from the center of said base, said partition being spaced between said two power terminals, said partition forming an arc edge; said female connector is provided with a shell protruding from an inner edge of said annular portion and used to fix said power terminal blocks, said shell being recessed with a groove between said two power terminal blocks, said groove forming a circular arc recess; when said arc edge of said partition is aligned with said circular arc recess of said shell, said male connector and said female connector are insertable into each other.

7. The connector used in underwater environments as claimed in claim 3, wherein said male connector is equipped with a sleeve, said sleeve being formed with an internal threaded portion at an inner edge of one end thereof and said sleeve being shrunk at an opposite end thereof to form a blocking ring; said ring forms a blocking surface on an opposite side of said male end extrusion surface, so that said blocking surface blocks said blocking ring in one direction; said female connector comprises an external threaded portion formed on an outer surface thereof; said female end extrusion surface is located between said external threaded portion and said annular portion; said internal threaded portion of said sleeve is locked on said external threaded portion to form a clamping extrusion of said male end extrusion surface and said female end extrusion surface to said elastic gasket.

8. The connector used in underwater environments as claimed in claim 7, wherein said male connector comprises a round tube extending in the opposite direction where said ring is provided, said round tube comprising a retaining ring at one end thereof away from said blocking surface; said blocking ring of said sleeve is limited to be located between said retaining ring and said blocking surface.

9. The connector used in underwater environments as claimed in claim 8, wherein said male connector is injected with rubber at said round tube and combined with a jacket; said retaining ring is protruding from said jacket, and an annular slope is formed at said retaining ring facing away from said blocking surface; said sleeve is cut to provide a plurality of slots at said blocking ring, and said slots allow said blocking ring to flexibly cross said annular slope and be assembled at said male connector.

* * * * *